US008764232B2

(12) United States Patent
Wilcox

(10) Patent No.: US 8,764,232 B2
(45) **Date of Patent: *Jul. 1, 2014**

(54) LIGHT-DIRECTING APPARATUS WITH PROTECTED REFLECTOR-SHIELD AND LIGHTING FIXTURE UTILIZING SAME

(71) Applicant: Cree, Inc., Durham, NC (US)

(72) Inventor: Kurt S. Wilcox, Libertyville, IL (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/971,505

(22) Filed: Aug. 20, 2013

(65) Prior Publication Data

US 2013/0335968 A1 Dec. 19, 2013

Related U.S. Application Data

(63) Continuation of application No. 13/647,162, filed on Oct. 8, 2012, now Pat. No. 8,511,854, which is a continuation of application No. 13/014,438, filed on Jan. 26, 2011, now Pat. No. 8,282,239, which is a continuation of application No. 12/173,149, filed on Jul. 15, 2008, now Pat. No. 7,891,835.

(51) Int. Cl.
*F21V 13/04* (2006.01)

(52) U.S. Cl.
USPC ..... 362/245; 362/248; 362/328

(58) Field of Classification Search
USPC ..... 362/296.1, 296.02, 298.05, 296.07, 362/297, 310, 311.15, 227, 235–237, 240, 362/243, 351, 360, 361, 245, 248, 328
See application file for complete search history.

(56) References Cited

U.S. PATENT DOCUMENTS

| | | | |
|---|---|---|---|
| 1,917,665 | A | 7/1933 | Rush |
| 2,007,033 | A | 7/1935 | Williams |
| 3,537,028 | A | 10/1970 | Pankove |
| 3,808,424 | A | 4/1974 | Rijinders |
| 4,232,359 | A | 11/1980 | Leon et al. |
| 5,130,761 | A | 7/1992 | Tanaka |
| 5,215,370 | A | 6/1993 | Kaplan |
| 5,526,239 | A | 6/1996 | Sato |
| 6,296,382 | B1 | 10/2001 | Hamelbeck |

(Continued)

FOREIGN PATENT DOCUMENTS

| | | | |
|---|---|---|---|
| EP | 0766115 | A1 | 4/1997 |
| EP | 2039985 | A2 | 3/2009 |
| WO | 2007100837 | A2 | 9/2007 |

OTHER PUBLICATIONS

Excerpts of International Search Report and Written Opinion for PCT/US09/03900. Date: Aug. 24, 2009. 4 pages.

*Primary Examiner* — John A Ward
(74) *Attorney, Agent, or Firm* — Jansson Munger McKinley & Shape Ltd.

(57) ABSTRACT

A light-directing apparatus for off-axial preferential-side distribution of light from a light emitter having an emitter axis. The light-directing apparatus includes a shield member within a lens member positioned over the light emitter. The lens member has an outer surface and an inner surface defining an emitter void and a shield-receiving void which is on a non-preferential side of the lens member. The shield-receiving void is different in configuration than the emitter void. The shield member is in the shield-receiving void in position in the path of light emitted toward the non-preferential side.

20 Claims, 13 Drawing Sheets

(56) References Cited

U.S. PATENT DOCUMENTS

| | | | | |
|---|---|---|---|---|
| 6,325,524 | B1 | 12/2001 | Weber et al. | |
| 6,619,825 | B2 | 9/2003 | Natsume | |
| 6,674,096 | B2 | 1/2004 | Sommers | |
| 6,705,743 | B1 | 3/2004 | Elembaby et al. | |
| 6,709,139 | B2 | 3/2004 | Ishida et al. | |
| 6,837,605 | B2 | 1/2005 | Reill | |
| 6,953,265 | B2 | 10/2005 | Suchiro et al. | |
| 6,969,946 | B2 | 11/2005 | Steranka et al. | |
| 6,972,439 | B1 | 12/2005 | Kim et al. | |
| 7,009,213 | B2 | 3/2006 | Camras et al. | |
| 7,025,487 | B2 | 4/2006 | Holzmann et al. | |
| 7,080,932 | B2 | 7/2006 | Keuper | |
| 7,090,370 | B2 | 8/2006 | Clark et al. | |
| 7,118,262 | B2 | 10/2006 | Negley | |
| 7,153,002 | B2 | 12/2006 | Kim et al. | |
| 7,182,480 | B2 | 2/2007 | Kan | |
| 7,244,924 | B2 | 7/2007 | Kiyomoto et al. | |
| 7,255,458 | B2 | 8/2007 | Ashdown | |
| 7,264,380 | B1 | 9/2007 | Monroe et al. | |
| 7,300,183 | B2 | 11/2007 | Kiyomoto et al. | |
| 7,314,296 | B2 | 1/2008 | Machi et al. | |
| 7,316,488 | B2 | 1/2008 | Wall, Jr. | |
| 7,452,115 | B2 | 11/2008 | Alcelik | |
| 7,563,008 | B2 | 7/2009 | Chinniah et al. | |
| 7,674,018 | B2 | 3/2010 | Holder et al. | |
| 7,766,509 | B1 | 8/2010 | Laporte | |
| 8,002,435 | B2 | 8/2011 | Laporte | |
| 8,282,239 | B2 * | 10/2012 | Wilcox | 362/245 |
| 8,511,854 | B2 * | 8/2013 | Wilcox | 362/245 |
| 2002/0181244 | A1 | 12/2002 | Griffin | |
| 2006/0138440 | A1 | 6/2006 | Jyo | |
| 2006/0227566 | A1 | 10/2006 | Lee | |
| 2008/0025044 | A1 | 1/2008 | Park et al. | |
| 2008/0117645 | A1 | 5/2008 | Ladbury et al. | |
| 2008/0117646 | A1 | 5/2008 | Yatsuda et al. | |
| 2008/0247161 | A1 | 10/2008 | Hulsey et al. | |
| 2010/0039810 | A1 | 2/2010 | Holder et al. | |
| 2010/0142201 | A1 | 6/2010 | Venturini | |

* cited by examiner

61

11

12

PLOT OF ILLUMINATION DISTRIBUTION
FROM A COMPARABLE APPARATUS
NOT USING THE PRESENT INVENTION

LIGHT-DIRECTING APPARATUS WITH PROTECTED REFLECTOR-SHIELD AND LIGHTING FIXTURE UTILIZING SAME

RELATED APPLICATION

This application is a continuation of patent application Ser. No. 13/647,162, filed Oct. 8, 2012, U.S. Pat. No. 8,511,854, issued Aug. 20, 2013, which is a continuation of patent application Ser. No. 13/014,438, filed Jan. 26, 2011, U.S. Pat. No. 8,282,239, issued Oct. 9, 2012, which is a continuation of patent application Ser. No. 12/173,149, filed Jul. 15, 2008, now U.S. Pat. No. 7,891,835, issued Feb. 22, 2011. The entire contents of the parent application Ser. Nos. 13/647,162, 13/14,438 and 12/173,149 are incorporated herein by reference.

FIELD OF THE INVENTION

The invention relates generally to the field of lighting systems and, more particularly, to apparatus for utilizing LED light sources for illuminating areas with predefined patterns of light intensity.

BACKGROUND OF THE INVENTION

There is a continuing need for lighting apparatus which is low-cost and energy efficient. LEDs (light-emitting diodes) provide light sources which are energy efficient; and advances in LED technology are providing even greater efficiencies over time.

Some of the newer applications for LED-based lighting systems are roadway and parking lot lighting in which there are desired performance and light-distribution characteristics. More specifically, it is desirable that certain regions generally beneath a light fixture be illuminated, while certain neighboring regions are essentially non-illuminated. Along roadways and in parking lots, there is a need to be able to direct light in a particular preferential lateral direction (e.g., to illuminate a roadway) while avoiding so-called "trespass light" in an opposite lateral direction (a non-preferential lateral direction), e.g., toward roadside houses.

The importance of avoiding trespass light (or the like) is such that in some cases sacrifices are made in lighting efficiency, by virtue of allowing absorption of light by shielding members. It would be highly desirable to provide a high-efficiency LED lighting system for roadways, parking lots and the like that avoids trespass light without significant efficiency losses.

It would be further desirable to provide a lighting fixture that maintains the desired light-directing characteristics and efficiency of operation at a substantially constant level throughout the fixture life. Such continued combination of advantages can be difficult to achieve because of susceptibility of light-managing components to damage, degradation and wear over a period of time.

SUMMARY OF THE INVENTION

One aspect of the present invention is an improved light-directing apparatus for preferential-side distribution of light from a light emitter which has an emitter axis. Another aspect of this invention is a lighting fixture utilizing such light-directing apparatus.

The inventive light-directing apparatus includes a lens member positioned over the light emitter, and also including a shield member. The lens member has a proximal end substantially transverse to the emitter axis and has an outer surface configured for refracting light from the emitter.

The shield member may be embedded within the lens member in a position in the path of light emitted toward the non-preferential side. In some embodiments, the shield member is embedded by the lens member having been molded thereabout.

In some preferred embodiments, the proximal end defines a shield-insertion opening. In such embodiments, the lens member further includes an inner surface defining an off-axis shield-receiving void extending from the shield-insertion opening. The shield member is snugly received in the shield-receiving void in a position in the path of light emitted toward a non-preferential side. The positioning of the shield-receiving void and the shield member therein are preferably such that the shield is off-set from the emitter axis.

The proximal end of the lens member may further define an emitter-insertion opening, and the inner surface of the lens defines an emitter-receiving void extending from the emitter-insertion opening and facing the emitter. The shield-insertion opening and the emitter-receiving opening are preferably in communication and form a single proximal-end opening. The shield-receiving void is preferably contiguous with the emitter-receiving void. The lens member is most typically bilaterally symmetric, as is the shield member.

The outer surface of the lens member is preferably a compound surface configured for refracting light from the emitter in a predominantly off-axial direction toward a preferential side. One type of a compound outer surface is disclosed in U.S. Pat. No. 7,618,163, the contents of which are incorporated herein by reference. The term "compound surface," as used herein with respect to the outer surface of a lens member (a lens), means a surface having portions of differing geometric shapes and/or including inflection regions between different portions thereof, e.g., convex portions on either side of a concave portion. "Compound surface" does not imply any particular shape, but the shape will be chosen for the desired lensing properties.

In preferred embodiments, the shield member includes a reflective front surface in the path of light emitted toward the non-preferential side to redirect such light toward the preferential side. The shield member may be formed of various plastic materials with a reflective coating. Such coated plastics are known to have a light-reflecting efficiency of about 85%. A still more efficient alternative is an anodized metal, such as aluminum, which provides a higher light-reflection efficiency, of about 95%.

The reflective front surface is preferably entirely within the lens member. Such enclosure provides highly desirable protection for the reflective surface, virtually eliminating damage, degradation and wear from exposure to elements.

The reflective front surface of the shield member is preferably of non-planar configuration. In some embodiments, the reflective front surface may have a plurality of sections angled with respect to each other. The sections may each be substantially planar. Alternatively, the reflective front surface may be formed by a single section, which may be flat or curved. The exact configuration of the shield portion, and its reflective front surface, whether it is planar or has a radius of curvature, are chosen to achieve the desired light-emitting characteristic for whatever product is being developed.

In some embodiments, the shield member includes a shield portion and a base portion. The reflective front surface is on the shield portion that extends from the base portion into the path of light emitted toward the non-preferential side. The base portion extends from the shield portion away from the light emitter at the proximal end of the lens member.

In certain embodiments of the inventive light-directing apparatus, the light emitter is an LED package which includes at least one LED and a primary lens over the LED. In such embodiments, the lens member is a secondary lens placed over the primary lens, and the reflective front surface faces the primary lens. In some other embodiments, there is space between the primary and secondary lenses and the space is filled with optical-grade gel. The primary lens may be substantially rotationally symmetrical around the emitter axis; preferably the primary lens is substantially hemispherical.

The term "LED package" is well known in the industry. LED packages have either a single light-emitting diode (LED) or a few closely-spaced LEDs on a base. Many LED packages include a primary reflector, which may be in the form of a so-called reflector cup mounted to the base or a reflective surface associated with the primary lens proximal the LED(s). One example of LED packages illustrated here in connection with the present invention includes a ring, preferably made of aluminum, around the primary lens on the base, which ring serves to position the primary lens and to reflect some light from the emitter to assist in the generation of an illumination pattern. Persons skilled in the art will appreciate that a broad variety of available LED packages are useful with the light-directing apparatus of the present invention.

The lens member preferably includes an outward flange around the opening(s) at the proximal end. The flange has an inner surface facing the mounting board. The base portion of the shield member is preferably at least partially against the inner surface of the flange. The outward flange may include a reference mark indicating an orientation with respect to the preferential side. Alternatively, the flange may have a specific shape, such as cut corners or the like, to indicate the orientation with respect to the preferential side. Such features are helpful in assembly of lighting fixtures using such light-directing apparatus.

The lighting fixture of this invention utilizes a plurality of light emitters, preferably LED packages, spaced from one another on a mounting board and oriented with substantially parallel axes. A light-directing apparatus is positioned over the light emitters for preferential-side distribution of light from the emitters. The light-directing apparatus includes a plurality of lenses, each positioned over one light emitter, and a plurality of shield members. Each lens has a proximal end transverse the emitter axis and defines a shield-insertion opening. Each lens has an inner surface defining an off-axis shield-receiving void extending from the shield-insertion opening, and a compound outer surface configured for refracting light from the emitter predominantly toward a preferential side. Each shield member is snugly received in the shield-receiving void of a corresponding one of the lenses in a position in the path of light emitted from the corresponding light emitter toward a non-preferential side.

In some embodiments of the inventive lighting fixture, the lenses have preferential sides in the same lateral direction, thereby to facilitate illumination toward one lateral direction.

In other embodiments, the lenses have preferential sides in different lateral directions, thereby to facilitate illumination in different lateral directions. The lenses may be arranged in a substantially circular pattern, and each lens has a preferential side oriented in a substantially radially outward direction with respect to the circular pattern. Some of such other embodiments may have subsets of the emitters and the corresponding lenses, with the subsets configured for directing light in different lateral directions.

One example of such other embodiments may have two subsets, one subset with its light-directing apparatuses configured for directing light toward a broad area (e.g., of a parking lot), and another smaller subset with its light-directing apparatuses configured for illumination of an adjacent sidewalk. In some other examples of the above-described embodiments, the emitters and their corresponding lenses are arranged in a substantially circular pattern, with each lens having a preferential side oriented in a substantially radially outward direction with respect to the circular pattern.

In the illustrated embodiment, each lens member (secondary lens) is a separate piece. In certain other embodiments, the plurality of lenses in the light-directing apparatus may be formed as portions of a single unitary piece, with the lens portions each positioned for proper placement over its corresponding emitter.

The term "preferential side," as used herein with respect to the light-distribution direction, means the lateral direction (with respect to the emitter axis) toward which illumination is desired. The term "non-preferential side," as used herein with respect to the direction of the light distribution, means the lateral direction toward which illumination is not desired. The non-preferential side is typically substantially radially opposite from the preferential side.

The term "snugly," as used herein with respect to positioning of the shield member inside the lens member, means that inner surface of the lens member which defines the shield-receiving void is configured for fitting closely against at least a portion of the shield-member surfaces to support the shield member in substantially fixed position with respect to the emitter axis. In other words, the shield-receiving void and the shield member are configured for a mating relationship sufficient to fix the position of the shield member with respect to the lens member, whether or not all surfaces of the shield member are in contact with surfaces of the lens member.

The term "being in communication," when used in reference to the emitter-insertion opening and the shield-insertion opening, means that the emitter-insertion opening may encompass the entire shield-insertion opening or that such openings may partially overlap. In either case, the term "being in communication" means that there is no barrier between such openings. (It should be understood that "opening" does not refer to something having volume, while "void" does imply volume.)

DETAILED DESCRIPTION OF PREFERRED EMBODIMENTS

Figure 1:
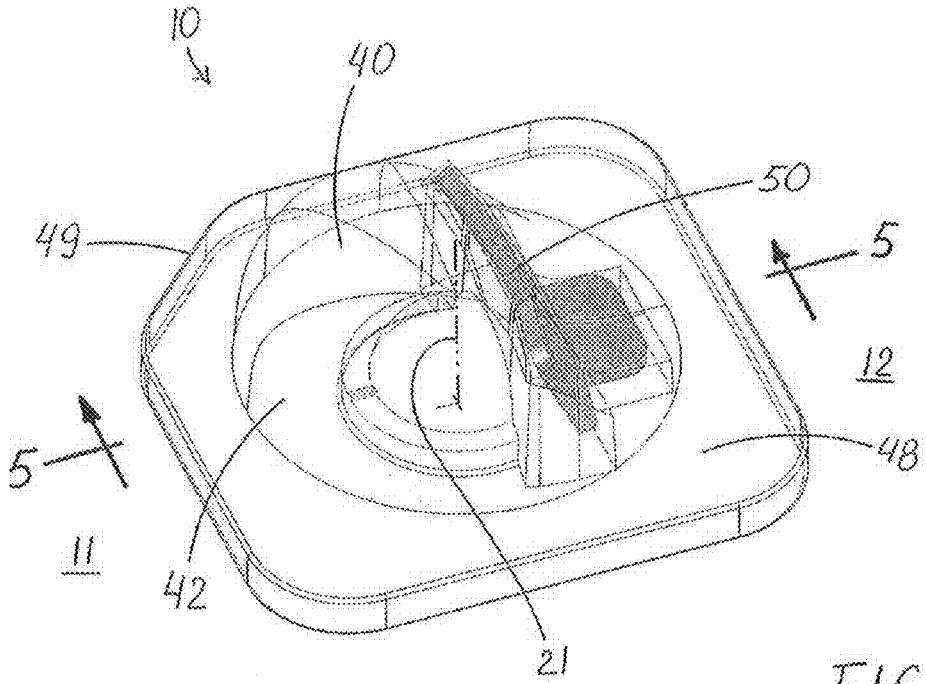
FIG. 1 is a perspective view of one embodiment of the light-directing apparatus of the invention, having a shield member inserted into a lens member.
Figure 2:
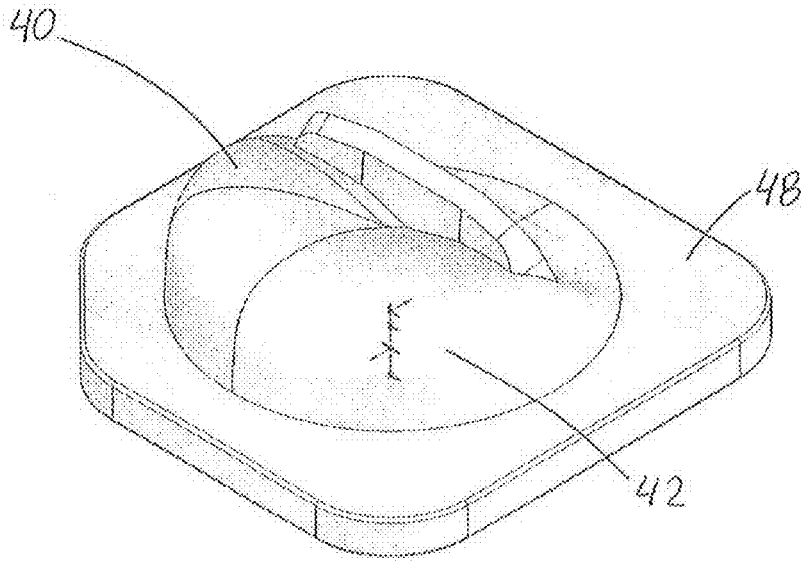
FIG. 2 is an opaque perspective view of the lens member of FIG. 1. (The lens member, of course, is light-transmissive rather than opaque as here shown; the opaque view helps in understanding the shape of the outer surface.)
Figure 3:
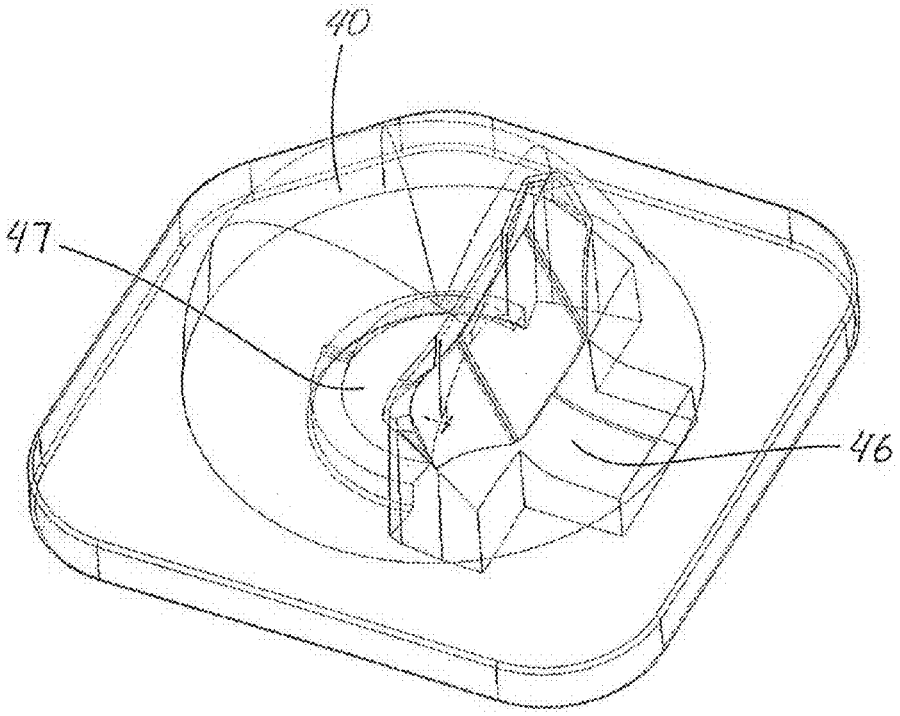
FIG. 3 is a perspective transparent view of the lens member without the shield member.
Figure 4:
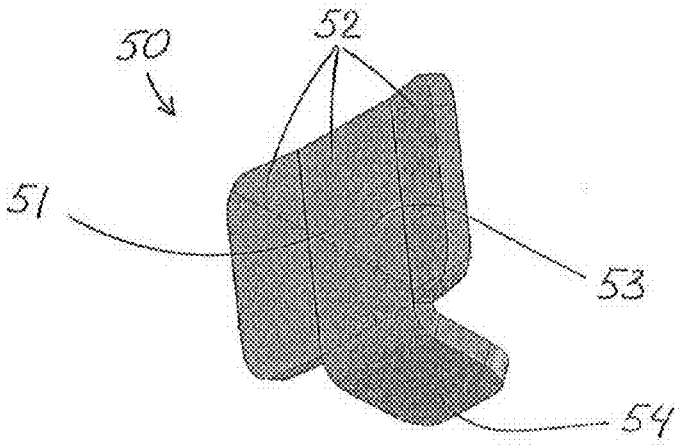
FIG. 4 is a perspective view of the shield member.

FIGS. 1-14 show embodiments of an inventive light-directing apparatus 10 in accordance with this invention for off-axial preferential-side distribution of light from a light emitter 20 which has an emitter axis 21. FIGS. 15-19 illustrate preferred embodiments of another aspect of this invention which is a lighting fixture 30 utilizing light-directing apparatus 10.

Inventive light-directing apparatus 10 includes a lens member 40 positioned over light emitter 20 and a shield member 50. As best seen in FIGS. 3, 5 and 7-9, lens member 40 has a proximal end 41 substantially transverse emitter axis 21 and an outer surface 42 configured for refracting light from emitter 20. In such embodiments, shield member 50 has been inserted into lens member 40.

Figure 6:
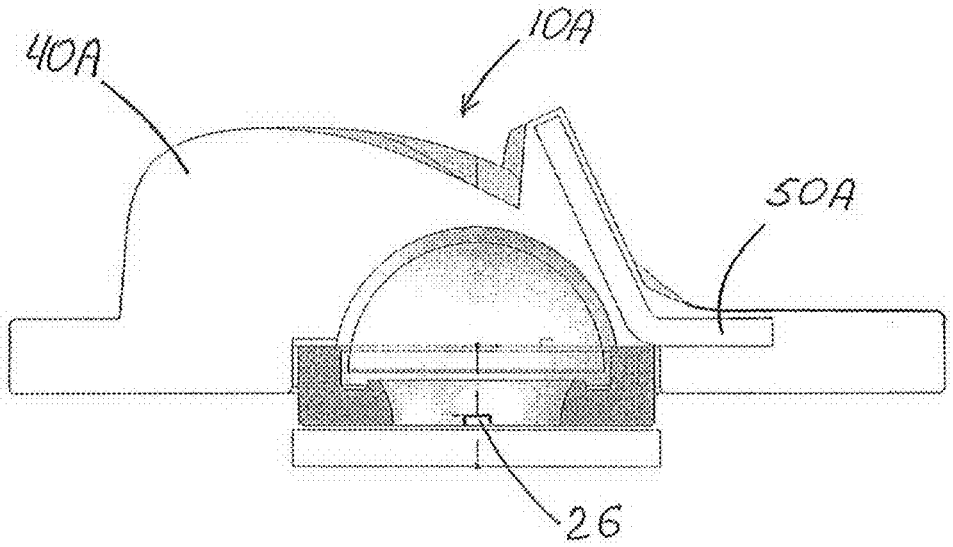
FIG. 6 is a similar cross-sectional view, but of another embodiment of the light-directing apparatus of this invention, in this case with the shield member embedded within the lens member.

FIG. 6 shows a light-directing apparatus 10A which is another embodiment of the invention, in this case with shield member 50A embedded within lens member 40A in a position in the path of light emitter toward the non-preferential side 12. Shield member 50A is embedded in lens member 40A by such lens member having been molded thereabout.

Figure 5:
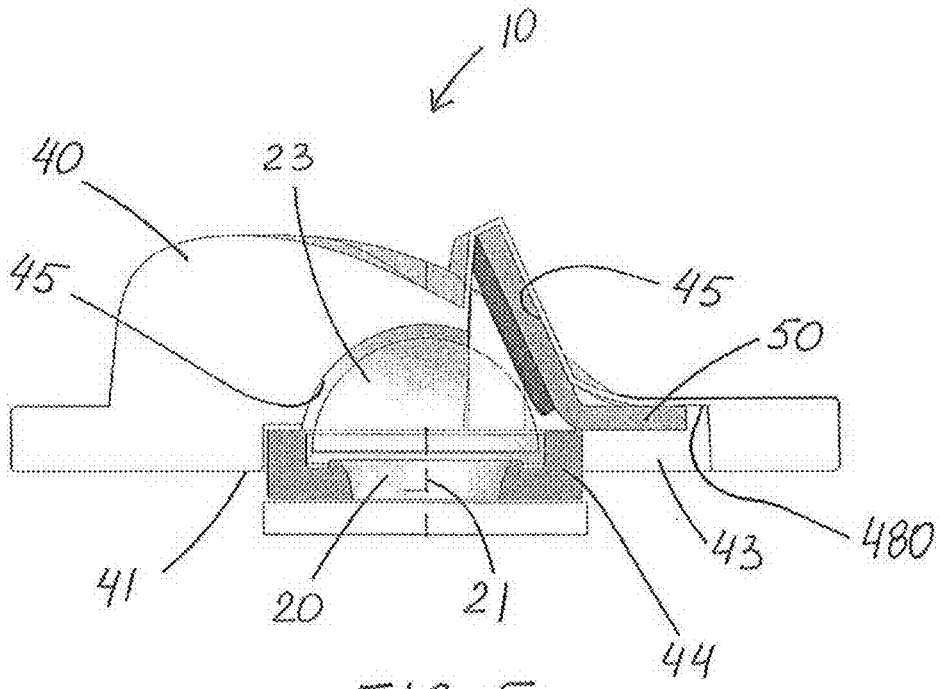
FIG. 5 is a sectional view of the light-directing apparatus, taken along section 5-5 as shown in FIG. 1.
Figure 7:
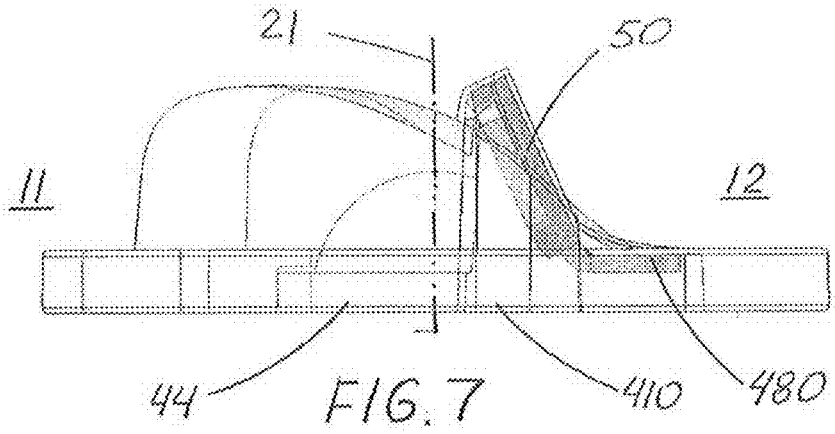
FIG. 7 is a front elevation of the light-directing apparatus of FIG. 1.
Figure 8:
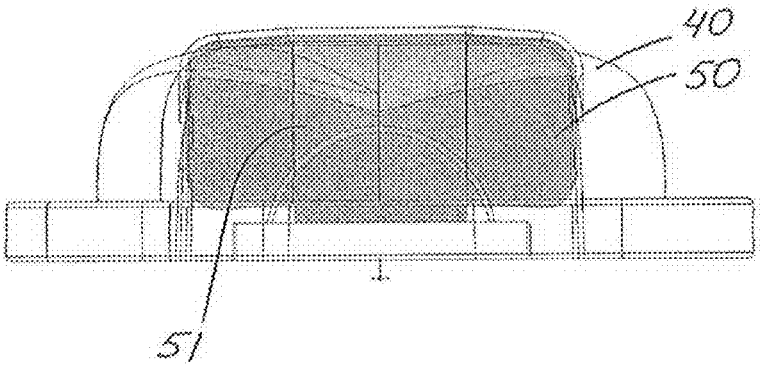
FIG. 8 is a left-side view of the light-directing apparatus of FIG. 7, which views the light-directing apparatus from the preferential illumination side.
Figure 9:
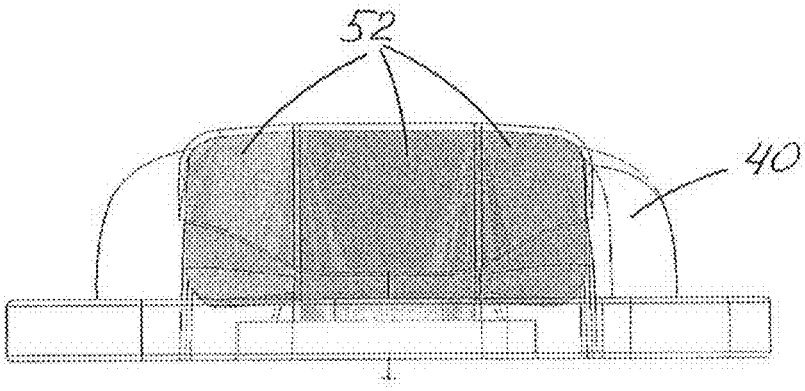
FIG. 9 is a right-side view of the light-directing apparatus of FIG. 7, which views the light-directing apparatus from the non-preferential illumination side.

FIGS. 5 and 7-9 illustrate that proximal end 41 of light-directing apparatus 10 defines a shield-insertion opening 43. Lens member 40 further includes an inner surface 45 which defines an off-axis shield-receiving void 46 extending from shield-insertion opening 43 and terminating at a close end. Shield member 50 is snugly received in shield-receiving void 46 in a position in the path of light emitted toward non-preferential side 12. As best seen in FIGS. 5 and 7, the positioning of shield-receiving void 46 and shield member 50 therein are such that shield 50 is off-set from emitter axis 21.

Figure 10:
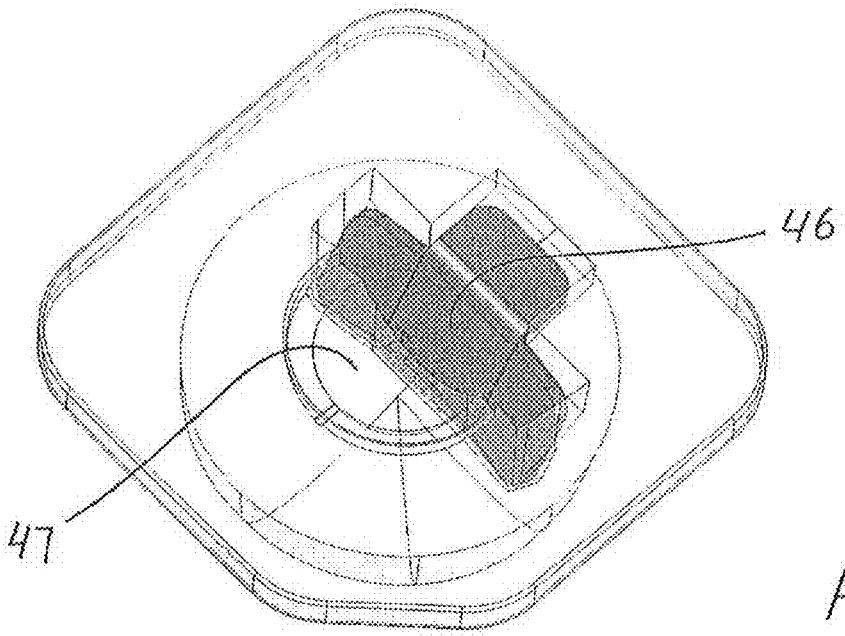
FIG. 10 is a perspective view from below of the light-directing apparatus of FIG. 1.
Figure 11:
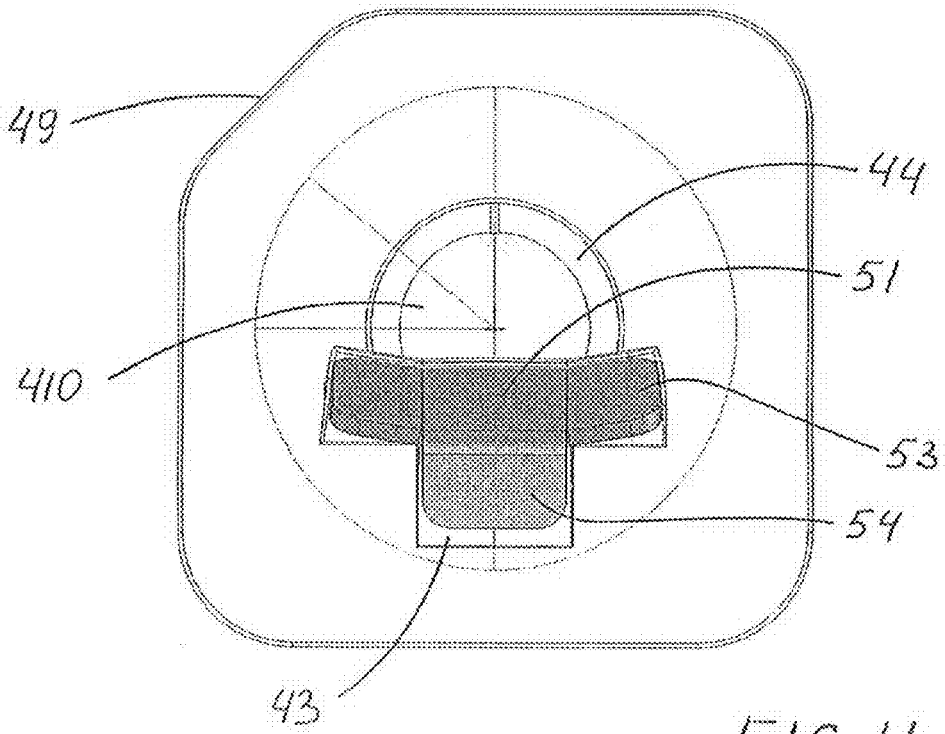
FIG. 11 is a bottom plan view of the light-directing apparatus of FIG. 1.
Figure 12:
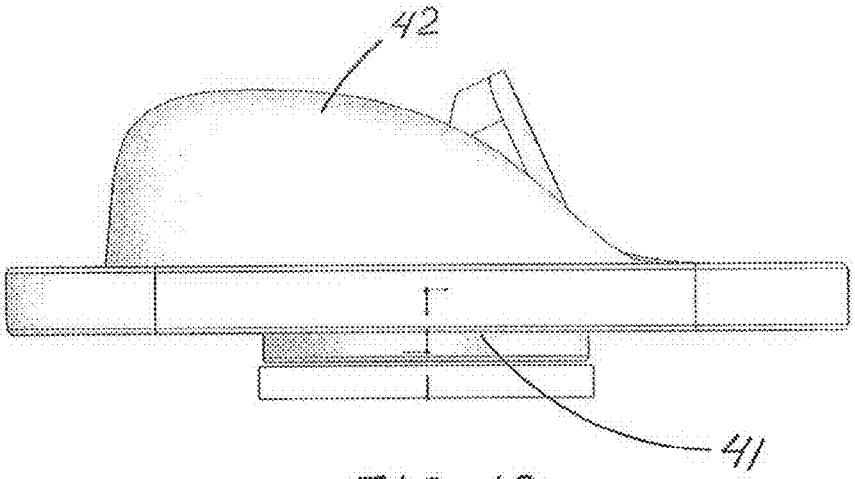
FIG. 12 is a front elevation of the light-directing apparatus shown in FIG. 2, with the lens member opaque for viewing purposes and including an emitter used with such lens member.
Figure 13:
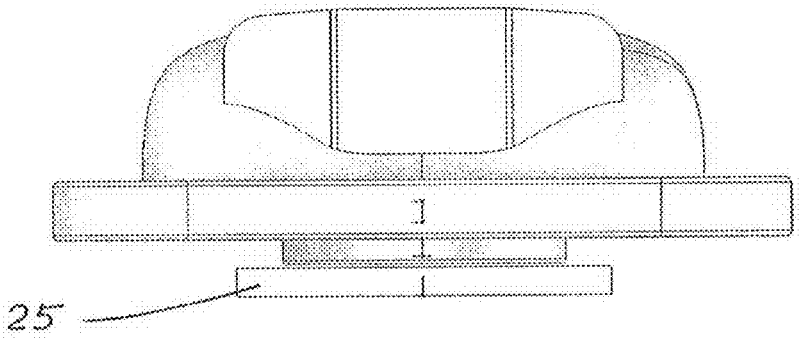
FIG. 13 is a right-side view of the light-directing apparatus of FIG. 12, which views the light-directing apparatus from the non-preferential illumination side.
Figure 14:
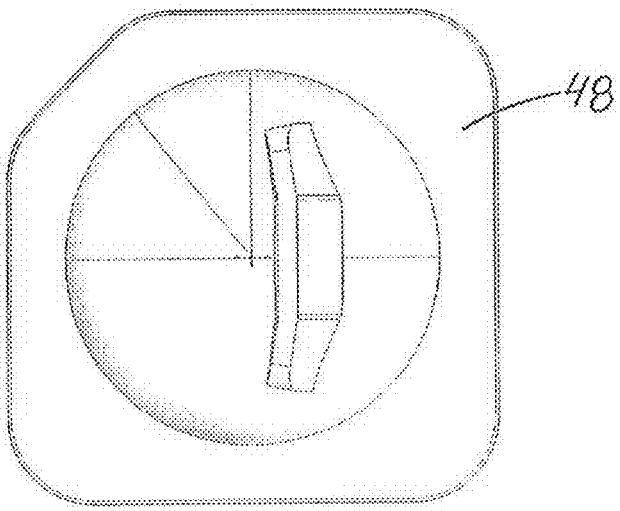
FIG. 14 is a top plan view of the light-directing apparatus of FIG. 2.

As best illustrated in FIGS. 5, 10 and 11, proximal end 41 of lens member 40 further defines an emitter-insertion opening 44. Inner surface 45, mentioned above, in addition to defining shield-receiving void 46, further defines an emitter-receiving void 47 extending from emitter-insertion opening 44 and facing emitter 20. It can be seen that shield-insertion opening 43 and emitter-receiving opening 44 are in communication and form a single proximal-end opening 410. As is further seen in FIG. 7, shield-receiving void 46 is contiguous with emitter-receiving void 47.

FIGS. 1, 3-14 show outer surface 42 of lens member 40 as a compound surface configured for refracting light from emitter 20 in a predominantly off-axial direction toward a preferential side 11. Lens member 40 is shown to be bilaterally symmetric, as is shield member 50.

Shield member 50 includes a reflective front surface 51 in the path of light emitted toward non-preferential side 12 to redirect such light toward preferential side 11. Reflective front surface 51 is entirely within lens member 40.

FIGS. 1, 4, 10 and 11 show a preferred embodiment in which reflective front surface 51 of shield member 50 is of non-planar configuration. Reflective front surface 51 has a plurality of sections 52 angled with respect to each other. As further seen in FIG. 4, sections 52 are each substantially planar.

Shield member 50 further includes a shield portion 53 which extends from a base portion 54 into the path of light emitted toward non-preferential side 12. Base portion 54 extends from shield portion 53 away from light emitter 20 at proximal end 41 of lens member 40. Reflective front surface 51 is on shield portion 53.

Figure 22:
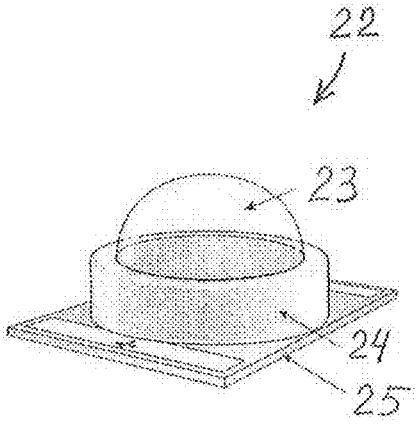
FIG. 22 is a perspective view of one type of an LED package with which the light-directing apparatus of this invention is used.

FIGS. 5, 6 and 22 illustrate light emitter 20 as an LED package 22 which includes an LED 26 and a primary lens 23 over the LED. As seen in FIGS. 5 and 6, lens member 40 is a secondary lens placed over primary lens 23, with reflective front surface 51 of shield member 50 generally facing primary lens 23. FIGS. 5, 6 and 22 show primary lens 23 as substantially rotationally symmetrical around emitter axis 21. Primary lens 23 is substantially hemispherical.

Figure 23:
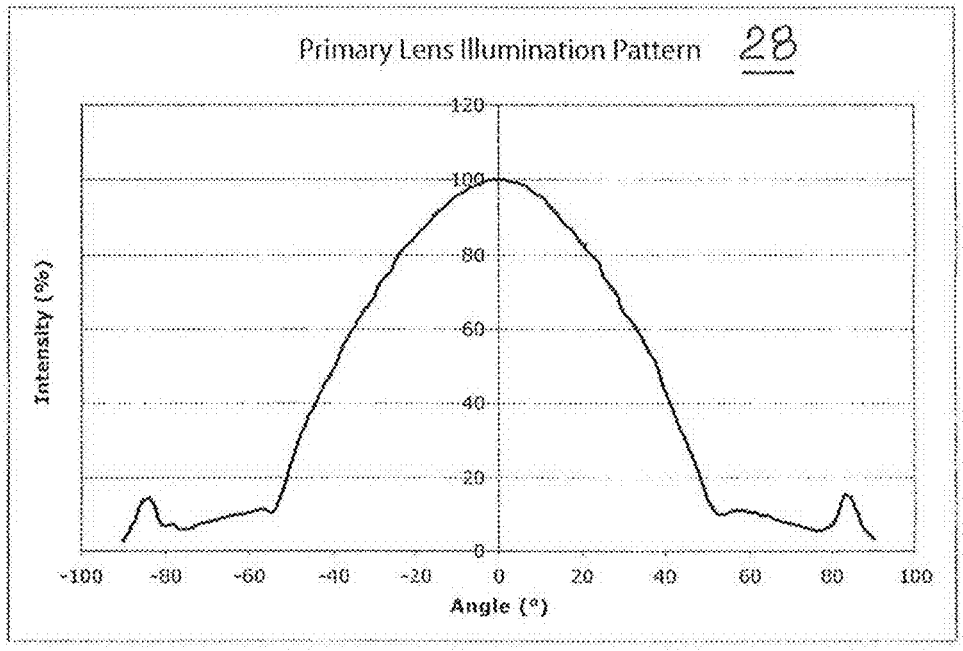
FIG. 23 is a graphical representation of the illumination pattern of the LED package of FIG. 22, showing the axially symmetrical light emission which is then modified by the light-directing apparatus of this invention.

LED package 22 shown in FIG. 22 includes a ring 24 around primary lens 23 on a base 25. Ring 24 serves to position lens 23 and reflect some light from the LED to assist in generation of illumination pattern 28, illustrated in FIG. 23.

Figure 15A:
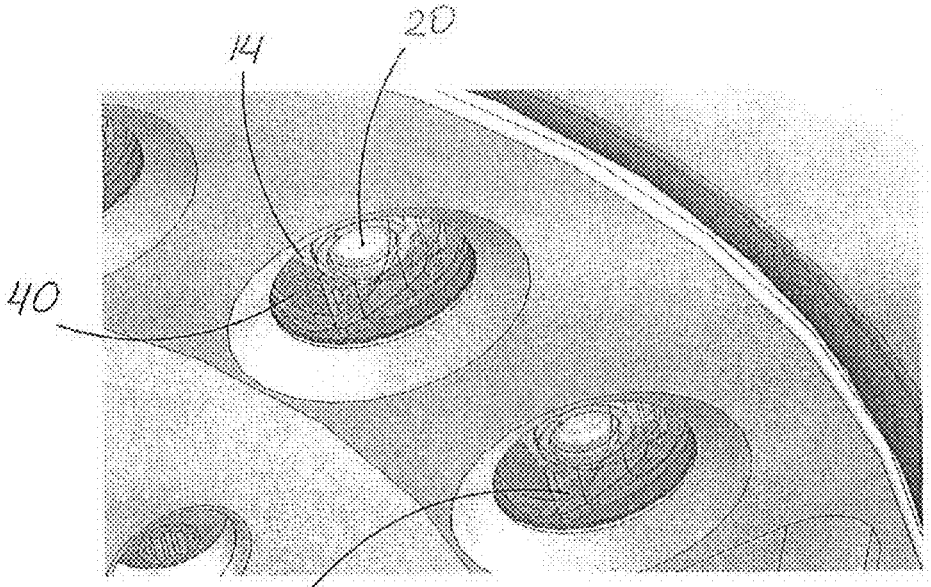
FIG. 15A is an enlarged fragmentary view of the light-directing apparatus of FIG. 15.
Figure 15:
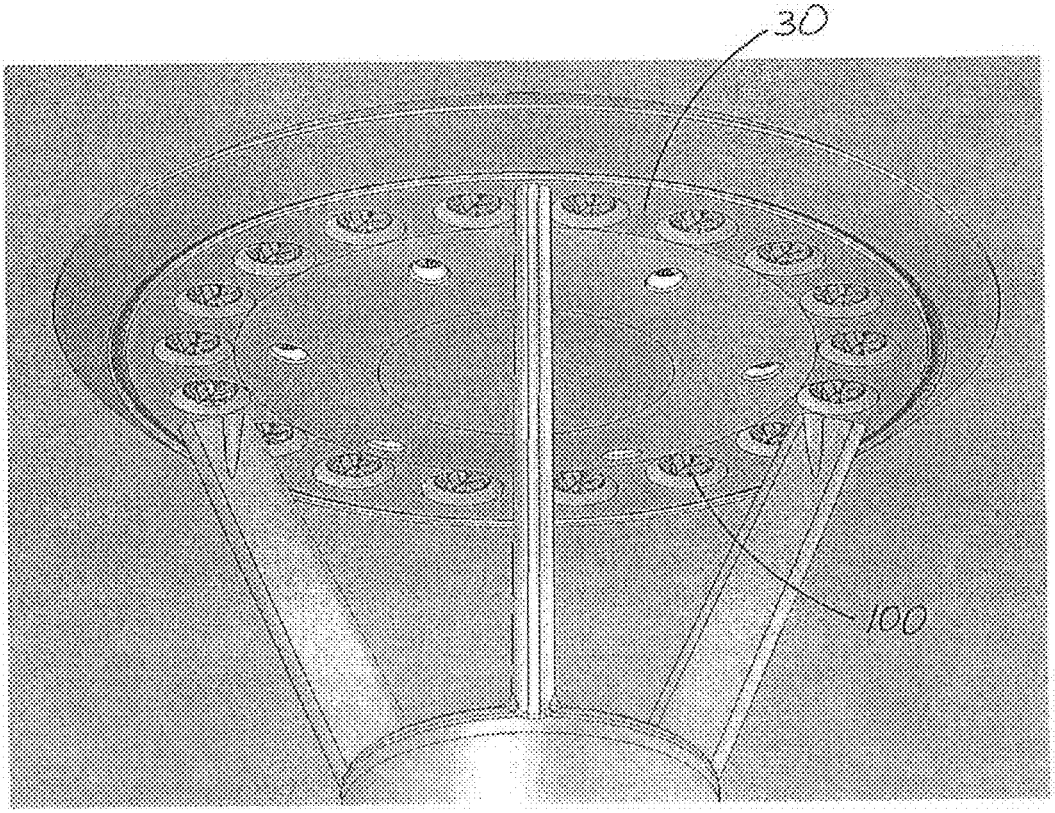
FIG. 15 is a perspective view from below of a lighting fixture according to the present invention.

Lens member 40 includes an outward flange 48 around the opening(s) at proximal end 41. Flange 48, and thus lens member 40, are secured with respect to a mounting board 14 which is part of a lighting fixture that includes a plurality of light-directing apparatuses of the sort described. (See FIG. 15A.) Flange 48 has an inner surface 480 facing mounting board 14 when mounted thereon. (See FIGS. 5 and 7.) Base portion 54 of shield member 50 is shown to be against inner surface 480 of flange 48. Flange 48 is further shown to have a special shape 49 such as a cut corner, to indicate the orientation with respect to preferential side 11. Such feature is helpful in assembly of lighting fixtures using light-directing apparatus 10.

Lighting fixture 30 shown in FIGS. 15-19 utilizes a plurality of light emitters 20 spaced from one another on mounting board 14 and oriented with substantially parallel axes. A light-directing apparatus 100 is positioned over light emitters 20 for off-axial preferential-side distribution of light from emitters 20. Light-directing apparatus 100 includes a plurality of lenses each of which is like lens member 40 and is positioned over one light emitter 20, and each has a shield member 50 associated with it, as described with respect to light-directing apparatuses 10 or 10A. Lenses 40 are arranged in a substantially circular pattern.

Figure 16:
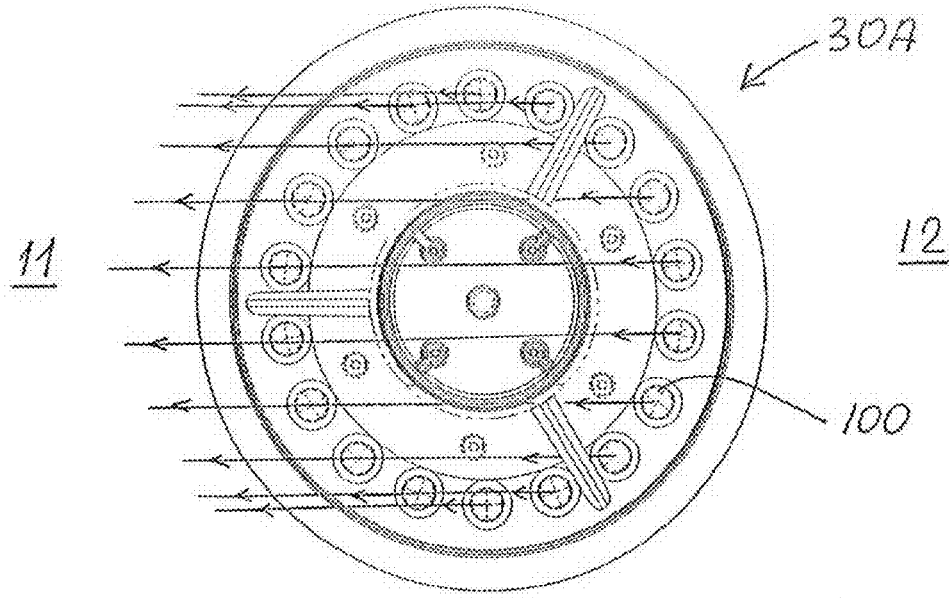
FIG. 16 is a reduced bottom plan view of the lighting fixture of FIG. 15, excluding the pole portion, but showing illumination toward a common lateral direction.
Figure 17:
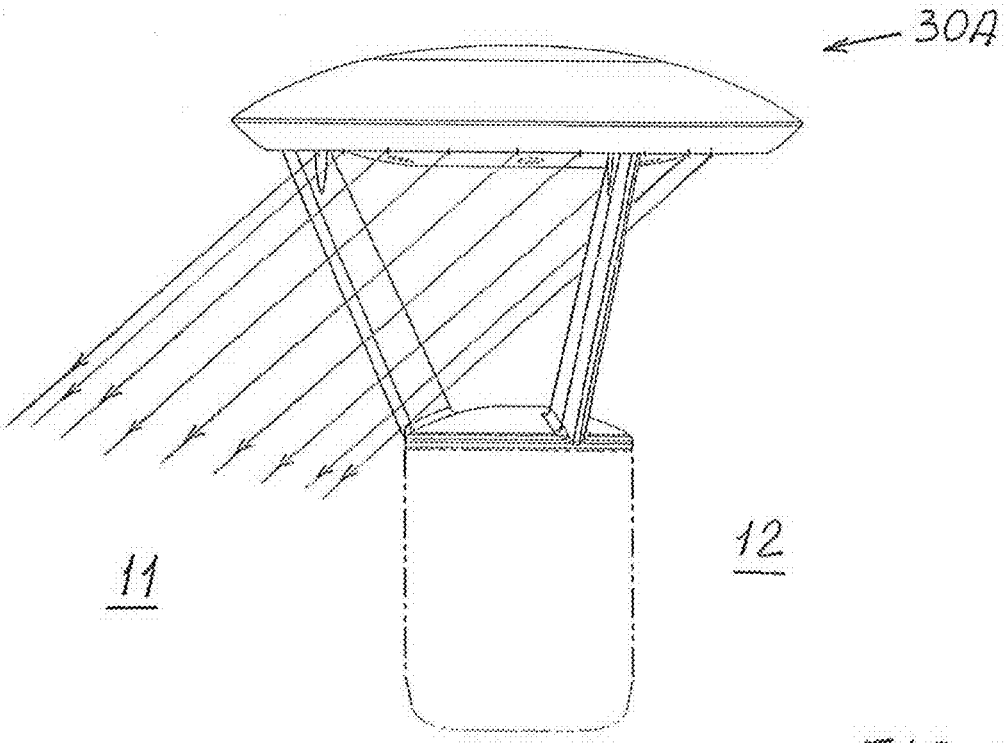
FIG. 17 is a front elevation of the light-directing apparatus of FIG. 16.
Figure 18:
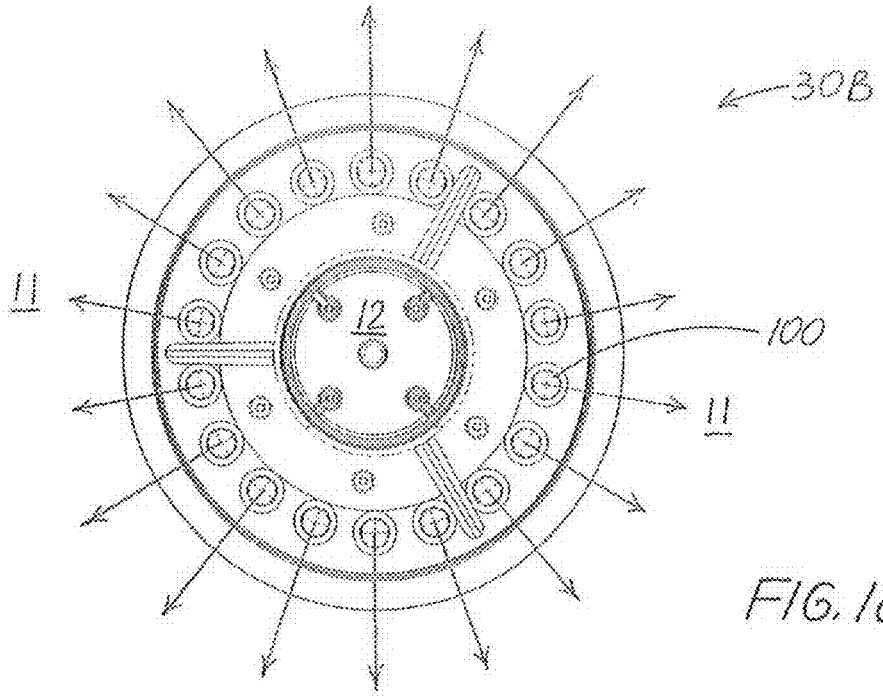
FIG. 18 is a bottom plan view as in FIG. 16, but of a lighting fixture with illumination toward different radial directions for illumination of a wide area.
Figure 19:
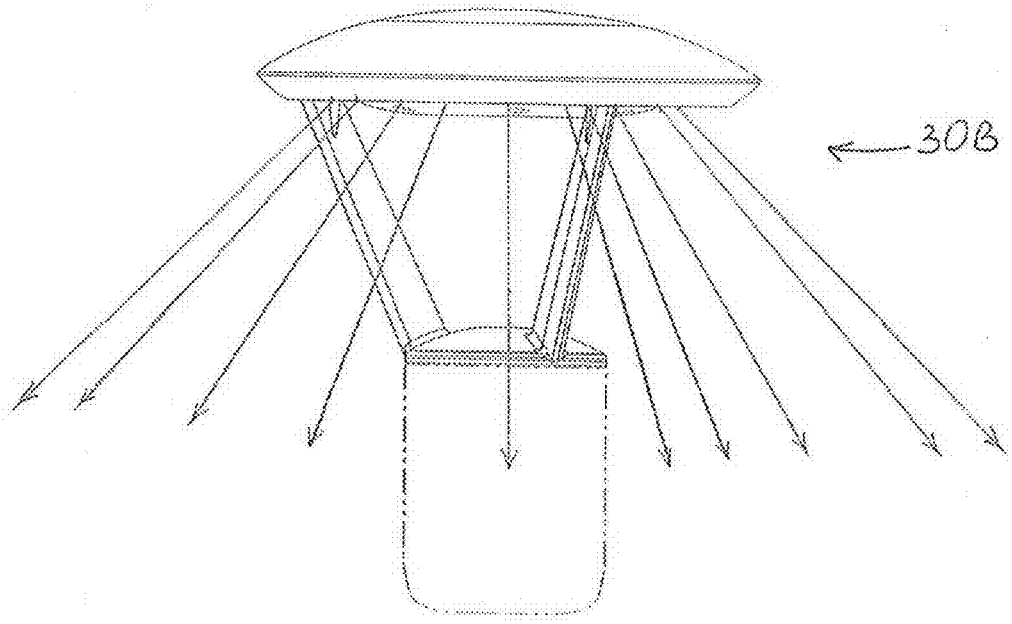
FIG. 19 is a front elevation of the light-directing apparatus of FIG. 18.

FIGS. 16 and 17 illustrate a lighting fixture 30A in which lenses 40 have their preferential sides 11 in the same lateral direction, thereby to facilitate illumination toward one lateral direction. FIGS. 18 and 19 show a lighting fixture 30B in which lenses 40 have their preferential sides 11 oriented in a substantially radially outward directions with respect to the circular pattern to give broad illumination which is generally symmetrical with respect to fixture 30B, as shown.

While FIGS. 1-3 and 5-14 illustrate lens members 40 as separate pieces, it should be recognized that in certain light-fixture uses utilizing a plurality of lens members 40, such as the fixtures illustrated in FIGS. 15-19, lens members 40 could be incorporated into a single formed member with each lens oriented in the desired direction.

Figure 21:
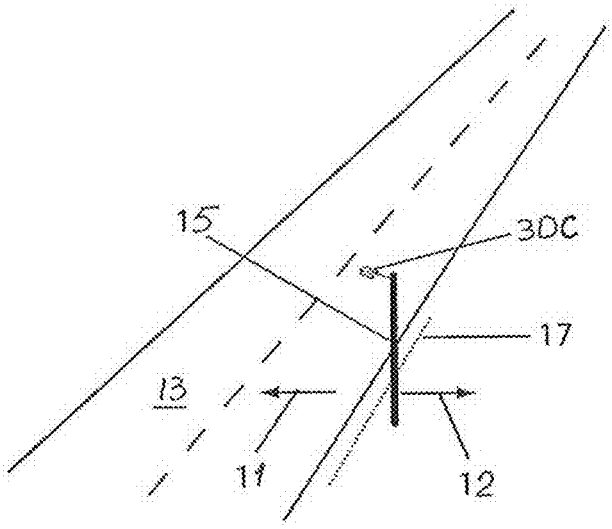
FIG. 21 is a schematic perspective representation of a pole-mounted lighting fixture in accordance with the present invention, the pole being positioned along the side of a roadway.

Referring now to FIG. 21, a roadway 13 is schematically illustrated with a light fixture 30C, which is in accordance with this invention, mounted at the top of a light pole 15 installed along roadway 13, with lighting fixture 30C positioned over the curb, which is illustrated by a curb line 17 (shown in dotted line). The direction arrow marked by reference number 11 indicates a preferential side (toward the roadway), and the direction arrow marked by reference number 12 points toward the opposite, non-preferential side.

Figure 20:
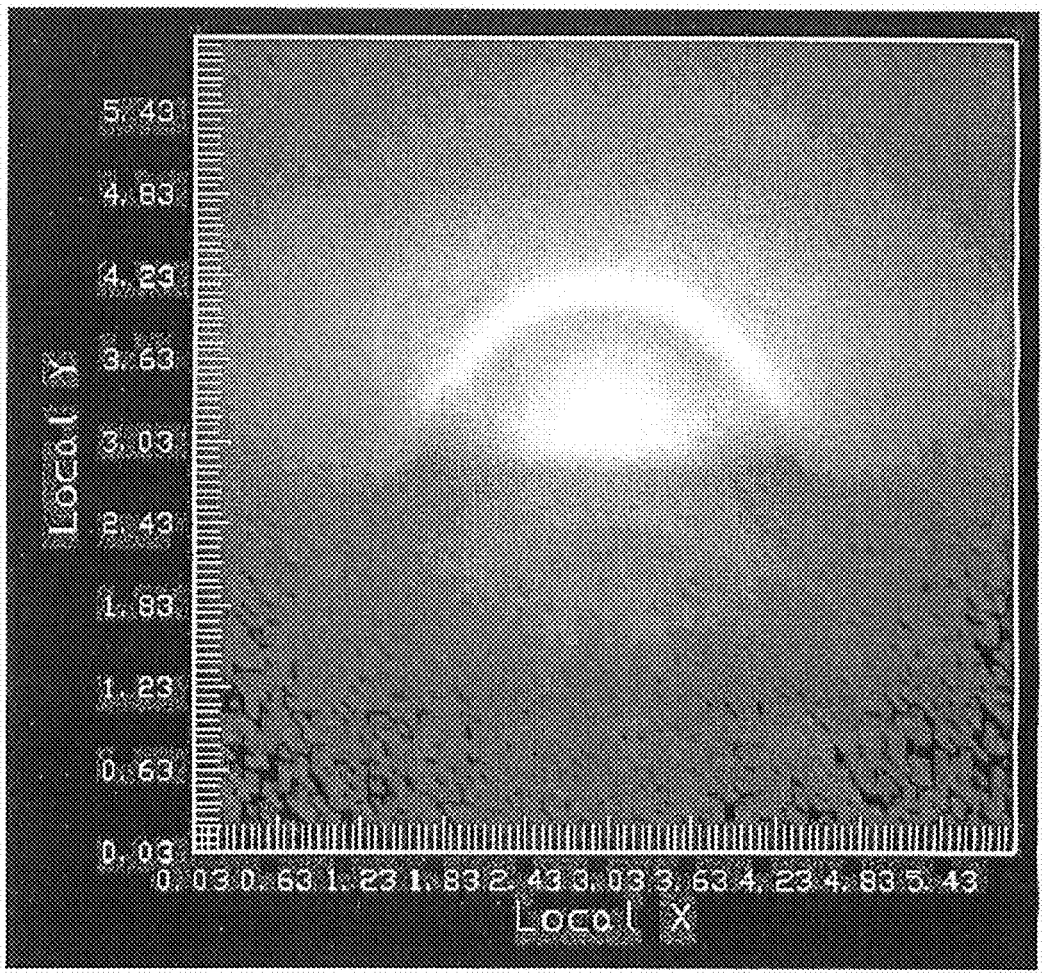
FIG. 20 is a two-dimensional plot of illumination intensity distribution of the inventive light-directing apparatus of FIG. 1.

FIG. 20 illustrates relative intensity distribution 61 by inventive light-directing apparatus 10, demonstrating that a great majority of the light emanating from apparatus 10 is redirected toward the preferential side 11, with no more than a minimal light reaching the non-preferential side 12. In other words, the amount of "trespass light" is minimized.

Figure 20A:
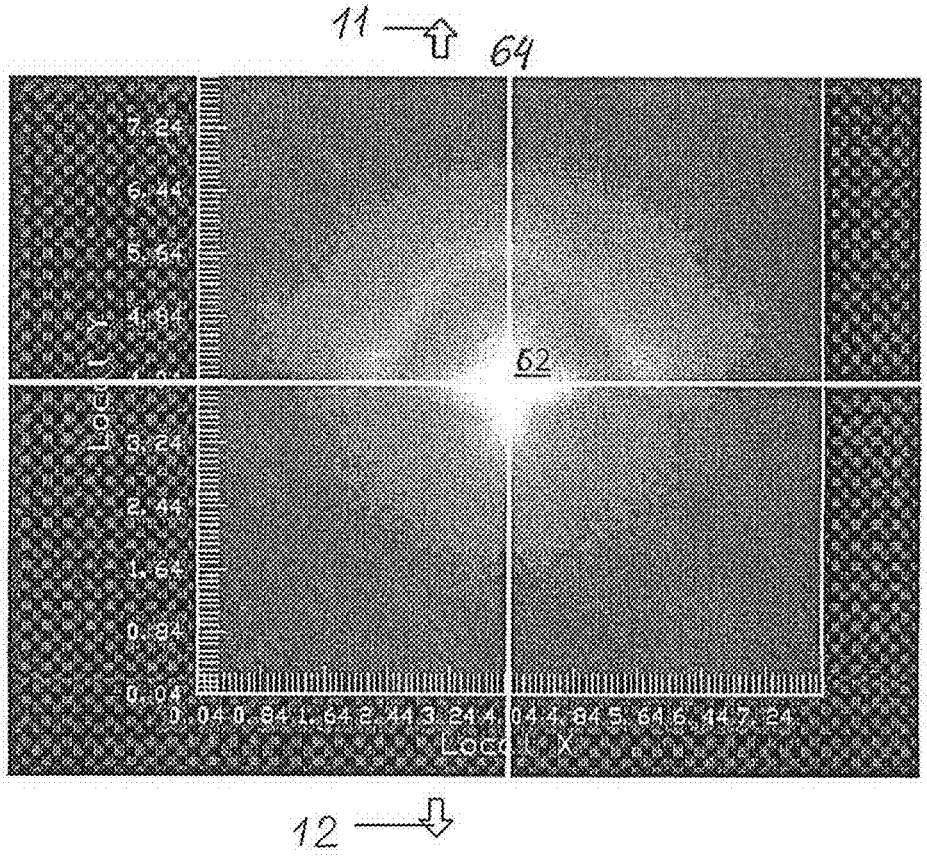
FIG. 20A is a two-dimensional plot of illumination intensity distribution, but from a comparable apparatus not incorporating the present invention.

FIG. 20A provides a comparison to show the advantages of the invention. FIG. 20A is a two-dimensional illumination intensity distribution 62 by single-light-emitter 20 with single primary lens 23 and a secondary lens which is substantially comparable in design to lens member 40 but for the fact that it does not accommodate an inserted or embedded shield member. The illumination pattern 62 in FIG. 20A shows, among other things, a greater amount of light toward the non-preferential side 12 than is the case in FIG. 20, which was generated using the present invention.

Light patterns 61 and 62 were generated using optical ray-tracing software to simulate the illumination intensity emanating from the respective apparatus.

While the principles of this invention have been described in connection with specific embodiments, it should be understood clearly that these descriptions are made only by way of example and are not intended to limit the scope of the invention.

The invention claimed is:

1. A light-directing apparatus for off-axial preferential-side distribution of light from a light emitter having an emitter axis, comprising:

a lens member positioned over the light emitter and having:

an inner surface defining an emitter void and a shield-receiving void which is on a non-preferential side of the lens member, the shield-receiving void being different in configuration than the emitter void; and an outer surface; and a shield member in the shield-receiving void in position in the path of light emitted toward the non-preferential side.

2. The light-directing apparatus of claim 1 wherein the outer surface is configured for refracting light from the emitter in a predominantly off-axial direction toward a preferential side.

3. The light-directing apparatus of claim 1 wherein the lens member further includes a proximal end transverse to the emitter axis and defining a shield-insertion opening and an emitter-insertion opening; and the emitter void is an emitter-receiving void extending from the emitter-insertion opening and facing the emitter.

4. The light-directing apparatus of claim 3 wherein the shield-insertion opening and the emitter-insertion opening are in communication and form a single proximal-end opening.

5. The light-directing apparatus of claim 4 wherein the shield-receiving void is contiguous with the emitter-receiving void.

6. The light-directing apparatus of claim 1 wherein the shield member includes a reflective front surface in the path of light emitted toward the non-preferential side to redirect such light toward the preferential side.

7. The light-directing apparatus of claim 6 wherein the reflective front surface is entirely within the lens member.

8. The light-directing apparatus of claim 7 wherein the reflective front surface of the shield member is non-planar.

9. The light-directing apparatus of claim 8 wherein the reflective front surface of the shield member has a plurality of sections angled with respect to each other.

10. The light-directing apparatus of claim 9 wherein the sections are each substantially planar.

11. The light-directing apparatus of claim 6 wherein the shield member includes a shield portion and a base portion.

12. The light-directing apparatus of claim 11 wherein:

the lens member further includes a proximal end transverse to the emitter axis and defining a shield-insertion opening;

the shield portion extends from the base portion into the path of light emitted toward the non-preferential side;

the base portion extends from the shield portion away from the light emitter at the proximal end of the lens member; and the reflective front surface is on the shield portion.

13. The light-directing apparatus of claim 1 wherein the light emitter comprises an LED.

14. The light-directing apparatus of claim 1 wherein:

the light emitter is an LED package including at least one LED and a primary lens over the LED;

the lens member is a secondary lens placed over and fully enclosing the primary lens; and the shield member includes a reflective front surface generally facing the primary lens.

15. The light-directing apparatus of claim 14 wherein the lens member includes an outward flange around the opening (s) at the proximal end.

16. The lighting fixture of claim 1 wherein the shield member is embedded in the lens which is molded about the shield member.

17. A lighting fixture with a plurality of light emitters spaced from one another on a mounting board, each light emitter having an emitter axis substantially parallel to the axes of the other light emitters, and light-directing apparatus positioned over the light emitters for off-axial preferential-side distribution of light from the emitters, the light-directing apparatus comprising:

a plurality of lenses each positioned over a respective one of the light emitters and each having:

an inner surface defining an emitter void and a shield-receiving void which is on a non-preferential side of the lens, the shield-receiving void being different in configuration than the emitter void; and an outer surface; and a plurality of shield members each disposed within the shield-receiving void of a respective one of the lenses and each in position in the path of light emitted from its respective light emitter toward the non-preferential side.

18. The lighting fixture of claim 17 wherein each lens is a separate piece.

19. The lighting fixture of claim 17 wherein:

each light emitter comprises an LED;

each lens is over and fully enclosing the corresponding light emitter; and each shield member includes a reflective front surface generally facing the corresponding light emitter.

20. The lighting fixture of claim 17 wherein each shield member is embedded in the respective lens which is molded about such shield member.

* * * * *